US007494215B2

(12) United States Patent
Stellbrink

(10) Patent No.: US 7,494,215 B2
(45) Date of Patent: Feb. 24, 2009

(54) MULTIPLE CHAMBER INK CARTRIDGE

(75) Inventor: Joseph Stellbrink, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 289 days.

(21) Appl. No.: 10/976,632

(22) Filed: Oct. 29, 2004

(65) Prior Publication Data

US 2006/0092245 A1 May 4, 2006

(51) Int. Cl.
*B41J 29/13* (2006.01)
*B41J 2/17* (2006.01)
*B41J 2/175* (2006.01)
*B41J 2/015* (2006.01)

(52) U.S. Cl. ..... 347/108; 347/84; 347/85; 347/86; 347/87; 347/20

(58) Field of Classification Search ..... 347/86, 347/87, 85, 84, 20, 108
See application file for complete search history.

(56) References Cited

U.S. PATENT DOCUMENTS 4,872,027 A * 10/1989 Buskirk et al. ..... 347/19
5,182,581 A * 1/1993 Kashimura et al. ..... 347/87
5,602,574 A * 2/1997 Williams ..... 347/43
5,812,165 A * 9/1998 Boyd et al. ..... 347/87
6,247,598 B1 * 6/2001 Hosaka et al. ..... 206/723
6,375,308 B1 * 4/2002 Shimada ..... 347/43
6,793,330 B2 * 9/2004 Usui et al. ..... 347/86
2003/0122906 A1 * 7/2003 Okamoto ..... 347/86
2003/0160841 A1 * 8/2003 Takata et al. ..... 347/50
2004/0125183 A1 * 7/2004 Lee et al. ..... 347/86
2004/0150695 A1 * 8/2004 Diaz-Felipe ..... 347/85
2004/0165044 A1 * 8/2004 Yamada ..... 347/86
2004/0189730 A1 * 9/2004 Kubo ..... 347/18
2004/0189757 A1 * 9/2004 Yamada ..... 347/86

* cited by examiner

*Primary Examiner*—Stephen D Meier
*Assistant Examiner*—Sarah Al-Hashimi

(57) ABSTRACT

In one embodiment, an ink cartridge for inkjet printing includes a housing enclosing four separate chambers for holding ink and a printhead affixed to the housing and operatively connected to each of the four ink chambers.

12 Claims, 3 Drawing Sheets

MULTIPLE CHAMBER INK CARTRIDGE

BACKGROUND

Ink cartridges used in inkjet printers include a printhead and one or more chambers that hold the ink. The printhead is a micro-electromechanical part that contains an array of miniature thermal resistors or piezoelectric transducers that are energized to eject small droplets of ink out of an associated array of orifices. The cartridge is mounted in a carriage in the printer and electrically connected to the printer controller. Under the direction of the controller, the cartridge is scanned back and forth across the print medium (usually paper) as resistors or transducers are energized to eject droplets of ink through the orifices on to the medium in the desired pattern.

Many color inkjet printers utilize a single three-chamber ink cartridge for printing color images—each chamber holds a different color ink, typically cyan, magenta and yellow ink. Some color inkjet printers utilize two three-chamber cartridges for printing higher quality color images, such as for photographs—the second cartridge typically holds light cyan, magenta and black inks. Recent developments of lower drop weight and dual drop weight inkjet printheads has made it possible to print higher quality color images with four colors—cyan, magenta, yellow and black. Hence, it would be desirable to have a new four-chamber design to provide an economical single cartridge for printing higher quality color images.

DRAWINGS

FIG. 1 is a perspective view illustrating an ink cartridge according to an embodiment of the invention.

FIGS. 2, 3 and 4 are section views taken along the lines 2-2, 3-3 and 4-4 in FIG. 1 illustrating four ink chambers according to an embodiment of the invention.

DESCRIPTION

Embodiments of the present invention were developed in an effort to design a new four-chamber cartridge to provide an economical single cartridge for printing higher quality color images. An ink cartridge is also commonly referred to as an ink pen, a print cartridge or an inkjet print head assembly. The exemplary embodiments shown in the figures and described below illustrate but do not limit the invention. Other forms, details, and embodiments may be made and implemented. For example, although it expected that embodiments of the invention will most often include only four ink chambers, corresponding to the four colors of ink currently used in most inkjet printing applications, embodiments may also include more than four ink chambers. Hence, the following description should not be construed to limit the scope of the invention, which is defined in the claims that follow the description.

Figure 2:
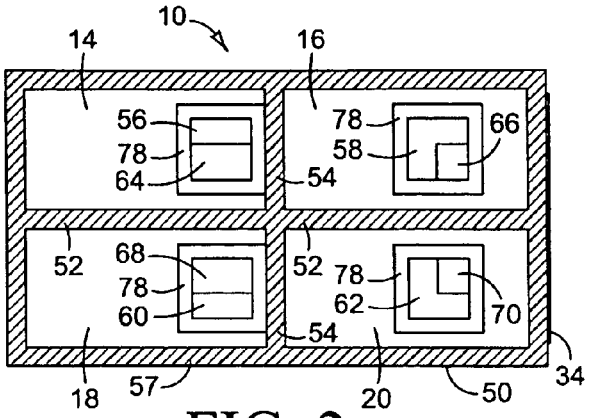
Figure 1:
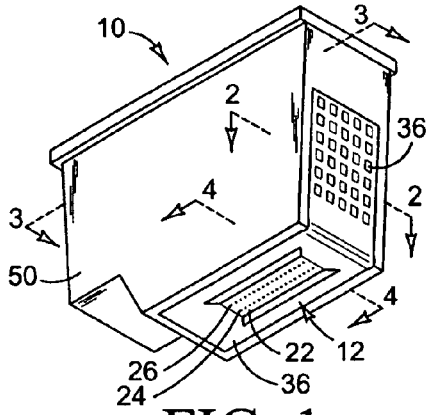
Figure 3:
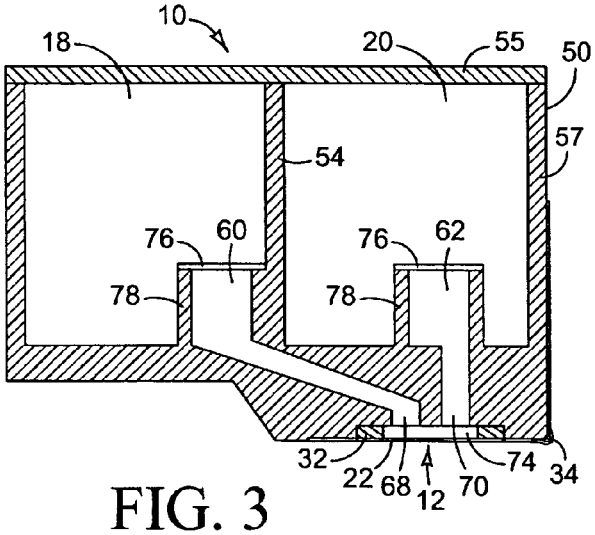
Figure 4:
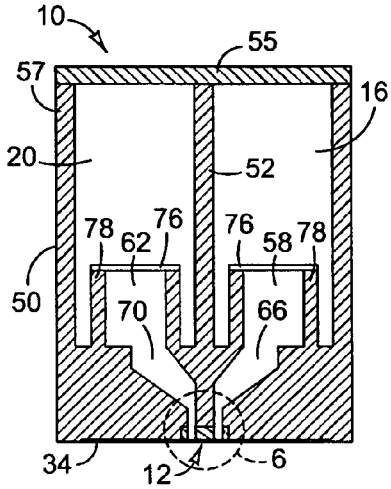
Figure 5:
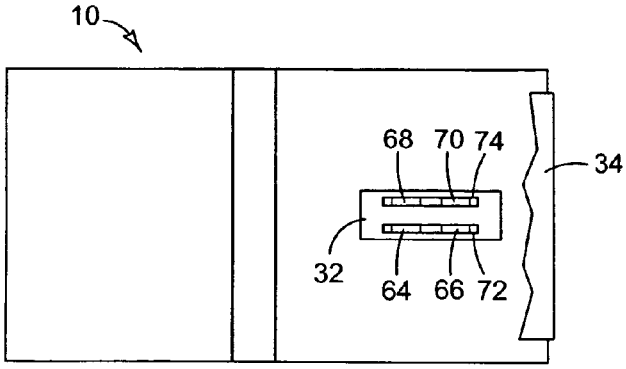
FIG. 5 is a bottom plan view of the cartridge of FIG. 1 showing the feed slots at the bottom of the ink chambers above the orifice plate.
Figure 6:
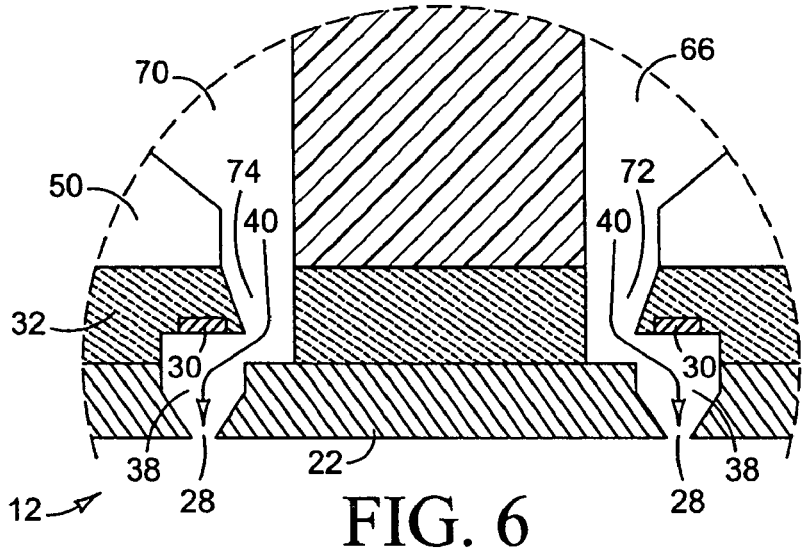
FIG. 6 is a detail section view of a portion of the printhead in the cartridge of FIG. 1.

FIGS. 1-6 illustrate an ink cartridge 10 for a thermal inkjet printer. Embodiments of the invention might also be implemented in an ink cartridge for a piezoelectric inkjet printer or any other inkjet printer in which it might be desirable to use a single print cartridge capable of holding four inks. FIG. 1 is a perspective view of cartridge 10. FIGS. 2, 3 and 4 are section views taken along the lines 2-2, 3-3 and 4-4 in FIG. 1. FIG. 5 is a bottom plan view and FIG. 6 is a detail section view of a portion of the printhead in cartridge 10. The relative scale and dimensions of some of the features of cartridge 10 have been greatly adjusted and some conventional features well known to those skilled in the art of inkjet printing have been omitted for clarity. Referring to FIGS. 1-6, cartridge 10 includes a printhead 12 located at the bottom of cartridge 10 below ink chambers 14, 16, 18 and 20. Printhead 12 includes an orifice plate 22 with two arrays 24, 26 of ink ejection orifices 28. In the embodiment shown, each array 24, 26 is a single row of orifices 28. Firing resistors 30 formed on an integrated circuit chip 32 are positioned behind ink ejection orifices 28. A flexible circuit 34 carries electrical traces from external contact pads 36 to firing resistors 30.

When ink cartridge 10 is installed in a printer, cartridge 10 is electrically connected to the printer controller through contact pads 36. In operation, the printer controller selectively energizes firing resistors 30 through the signal traces in flexible circuit 34. When a firing resistor 30 is energized, ink in a vaporization chamber 38 next to a resistor 30 is vaporized, ejecting a droplet of ink through orifice 28 on to the print media. The low pressure created by ejection of the ink droplet and cooling of chamber 38 then draws ink from an ink supply to refill vaporization chamber 38 in preparation for the next ejection. The flow of ink through printhead 12 is illustrated by arrows 40 in FIG. 6.

Referring now to the section views of FIGS. 2-4, ink is stored in four chambers 14, 16, 18 and 20 formed within cartridge housing 50. Each chamber 14-20 may be used to store a different color ink, typically cyan, magenta, yellow and black. Ink chambers 14-20 are separated from one another by partitions 52 and 54. Housing 50, which is typically formed from a plastic material, may be molded as a single unit, molded as two parts (e.g., a lid 55 and a body 57 that includes partitions 52 and 54) or constructed of any number of separate parts fastened to one another in the desired configuration. An outlet 56, 58, 60 and 62 is located near the bottom of each ink chamber 14-20. Referring now also to FIG. 5, a conduit 64, 66, 68 and 70 leads from each chamber outlet 56-62 to one of two feed slots 72 and 74. Each feed slot 72, 74 is aligned with and positioned over an orifice array 24, 26. Ink passes from each chamber 14-20 through a corresponding outlet 56-62 and conduit 64-70 to feed slot 72, 74 and printhead 12, where it is ejected through an orifice array 24, 26 as described above.

Each outlet 56-62 is usually covered by a filter 76 to keep contaminants, air bubbles and ink flow surges from entering printhead 12. Ink stored in chambers 14-20 is often held in a foam or other porous material (not shown) to retain the ink at an appropriate backpressure through capillary action. Where foam is used, a stand pipe 78 extends upward at each outlet 56-62 to locally compress the foam and increase its capillarity in the region of pipe 78. As ink is depleted from the foam in a chamber 14-20, the increased capillarity near pipe 78 tends to draw ink from all other portions of the foam to maximize the amount of ink drawn from the chamber 14-20.

In the embodiment shown in FIGS. 2-4, ink chamber outlets 56-62 are arranged in a generally rectangular pattern in which the outlets are aligned from front to rear (outlets 56/58 and 60/62) and from side to side (56/60 and 58/62). In the embodiment shown in FIGS. 7-8, outlets 56-62 are arranged in a generally trapezoidal pattern in which the front outlets 58 and 62 are located closer to longitudinal partition 52 than are rear outlets 56 and 60. In one common conventional three chamber cartridge design, the ink chamber outlets are arranged in a triangular pattern with a single front chamber outlet and two rear chamber outlets. Such a conventional three chamber cartridge design can be, for example, adapted to the embodiment of FIGS. 7-8 by splitting or otherwise configuring the single front chamber/outlet into two chambers/outlets with a front partition. In the embodiment shown in FIG. 9, each of the four ink chambers 14-20 are arranged side by side across housing 50. Conduits 64 and 70 for two outboard outlets 56 and 62 are positioned toward the front of outboard chambers 14 and 20 and conduits 66 and 68 for two inboard outlets 58 and 60 in inboard chambers 16 and 18 are positioned rearward of the outboard conduits 64 and 70. Other configurations are possible. Each of the embodiments shown in FIGS. 2-4, 7-8 and 9 allow for four ink chambers/colors within the same housing as a conventional three chamber/color cartridge, for example, without significant additional molding complexity (if any). Other configurations are possible.

Figure 7:
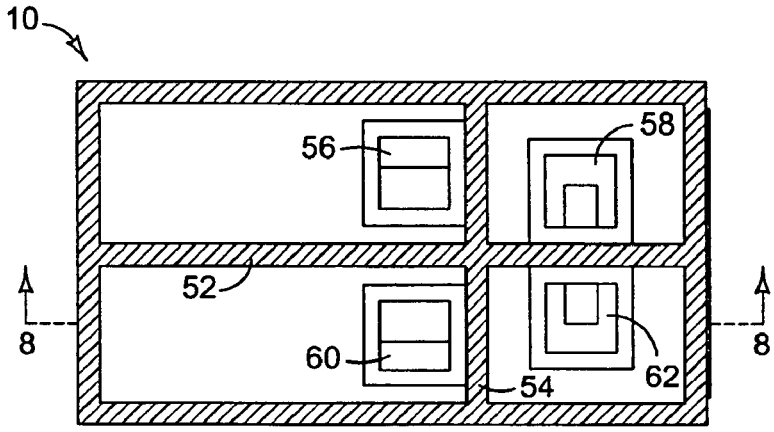
FIGS. 7 and 8 are section views illustrating four ink chambers according to an embodiment of the invention.
Figure 8:
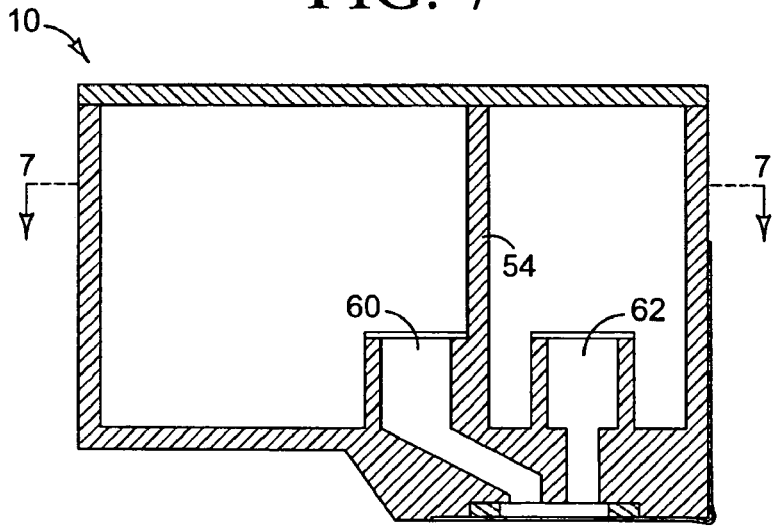
Figure 9:
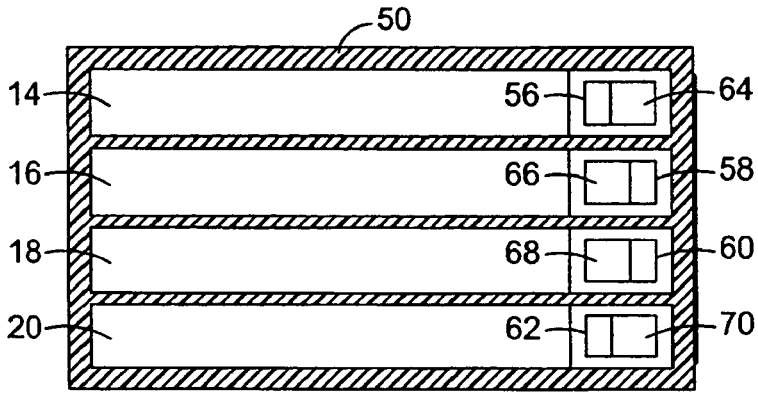
FIG. 9 is a section view illustrating four ink chambers according to an embodiment of the invention.
Figure 10:
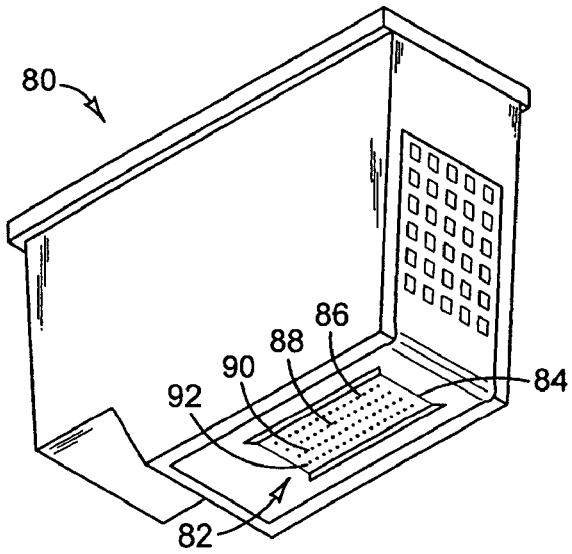
FIG. 10 is a perspective view illustrating an ink cartridge according to an embodiment of the invention.
Figure 11:
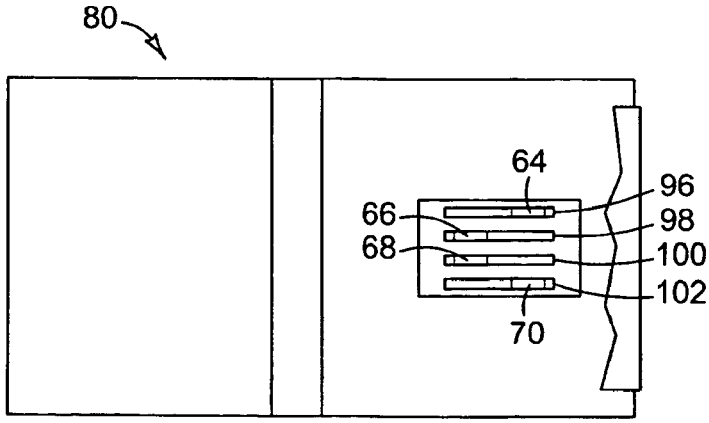
FIG. 11 is a bottom plan view of the cartridge of FIG. 10 showing the feed slots at the bottom of the ink chambers above the orifice plate.

FIGS. 10 and 11 illustrate a print cartridge 80 in which the printhead 82 includes an orifice plate 84 with four arrays 86, 88, 90 and 92 of ink ejection orifices 28. In the embodiment shown, each array 86-92 is a single row of orifices 28. Each of four feed slots 96, 98, 100 and 102 is aligned with and positioned over an orifice array 86-92. Ink passes from each ink chamber through a corresponding outlet and conduit to a feed slot 96-102 and printhead 82, where it is ejected through an orifice array 86-92 as described above. For example, if the four chamber arrangement shown in FIG. 9 is used, then ink from outboard chambers 14 and 20 might flow to the two outboard feed slots 96 and 102 through conduits 64 and 70 and ink from inboard chambers 16 and 18 would flow to inboard feed slots 98 and 100 through conduits 66 and 68. In another example, if the four chamber arrangement shown in FIGS. 2 or 7 is used, then ink from forward chambers 16 and 20 might flow to the two inboard feed slots 98 and 100 and ink from rear chambers 14 and 18 would flow to the two outboard feed slots 96 and 102. Again, other configurations are possible.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. An ink cartridge for inkjet printing, comprising:

four separate chambers for holding ink housed together within a single housing wherein adjacent chambers share a partition on the inside of the housing and the single housing comprises a body and a lid attached to the body and the adjacent chambers share a partition formed in the body of the housing; and a printhead affixed to the housing and operatively connected to each of the four ink chambers, the printhead being in fluid communication with a first two of the ink chambers through a single first elongated opening and with a second two of the ink chambers through a single second elongated opening oriented parallel to the first opening.

2. The ink cartridge of claim 1, wherein the housing enclosing four separate chambers for holding ink comprises a housing enclosing exactly four separate chambers for holding ink.

3. The ink cartridge of claim 1, further comprising cyan ink in a first one of the ink chambers, magenta ink in a second one of the ink chambers, yellow ink in a third one of the ink chambers and black ink in a fourth one of the ink chambers.

4. The ink cartridge of claim 1, further comprising a separate conduit between each of the ink chambers and the corresponding opening.

5. An ink cartridge for inkjet printing, comprising:

a single housing defining therein first, second, third and fourth chambers for holding ink;

a printhead affixed to the housing, the printhead including first and second arrays of orifices through which ink may be ejected from the cartridge;

the first and second ink chambers in fluid communication with the entire first array of orifices and the third and fourth ink chambers in fluid communication with the entire second array of orifices;

a longitudinal partition separating the first and second ink chambers from the third and fourth ink chambers;

a transverse partition separating the first and third ink chambers from the second and fourth ink chambers;

a first outlet from the first ink chamber to the first array of orifices;

a second outlet from the second ink chamber to the first array of orifices;

a third outlet from the third ink chamber to the second array of orifices;

a fourth outlet from the fourth ink chamber to the second array of orifices; and the first, second, third and fourth outlets arranged in a generally trapezoidal pattern in which the second and fourth outlets are located closer to the longitudinal partition than are the first and third outlets.

6. The ink cartridge of claim 5, wherein the housing having therein first, second, third and fourth chambers for holding ink comprises a housing having exactly four chambers for holding ink.

7. The ink cartridge of claim 5, wherein the single housing comprises a body and a lid attached to the body.

8. An ink cartridge for inkjet printing, comprising:

a single housing defining therein first, second, third and fourth chambers for holding ink;

a printhead affixed to the housing at a location nearer to one end of the housing and farther from an opposite end of the housing, the printhead including four arrays of orifices through which ink may be ejected from the cartridge;

each of the ink chambers in fluid communication with a corresponding one of the arrays of orifices through an outlet from the chamber; and the outlets are arranged in a generally rectangular pattern in which the first and second ink chamber outlets are aligned along a first line extending from one end of the housing to the opposite end of the housing and the third and fourth ink chamber outlets are aligned along a second line parallel to the first line, or the outlets are arranged in a generally trapezoidal pattern in which the first and third ink chamber outlets are spaced apart from one another a first distance and the second and fourth ink chamber outlets are spaced apart from one another a second distance smaller than the first distance.

9. The ink cartridge of claim 8, wherein the single housing comprises a body and a lid attached to the body.

10. An ink cartridge for inkjet printing, comprising:

exactly four chambers for holding ink, the four chambers defined at least in part by a plurality of partitions and each pair of adjacent chambers sharing a partition;

first and second arrays of orifices through which ink may be ejected from the cartridge;

first and second ink chambers each having an outlet to the entire first array of orifices;

third and fourth ink chambers each having an outlet to the entire second array of orifices; and wherein the outlets are arranged in a generally rectangular pattern in which the first and second ink chamber outlets are aligned over the first array of orifices and the third and fourth ink chamber outlets are aligned over the second array of orifices, or the outlets are arranged in a generally trapezoidal pattern in which the first and third ink chamber outlets are spaced apart from one another a first distance and the second and fourth ink chamber outlets are spaced apart from one another a second distance smaller than the first distance.

11. The ink cartridge of claim 10, wherein the outlets are arranged in a generally trapezoidal pattern in which the first and third ink chamber outlets are spaced apart from one another a first distance and the second and fourth ink chamber outlets are spaced apart from one another a second distance smaller than the first distance.

12. The ink cartridge of claim 11, further comprising:

a longitudinal partition separating the first and second ink chambers from the third and fourth ink chambers;

a transverse partition separating the first and third ink chambers from the second and fourth ink chambers; and wherein the second and fourth ink chamber outlets are located immediately adjacent to the longitudinal partition.

* * * * *